US007744416B2

(12) United States Patent
Zhang et al.

(10) Patent No.: US 7,744,416 B2
(45) Date of Patent: Jun. 29, 2010

(54) HIGH SPEED ELECTRICAL CONNECTOR ASSEMBLY WITH SHIELDDING SYSTEM

(75) Inventors: George (Huanyi) Zhang, Irvine, CA (US); Gustavo F. Duenas, Placentia, CA (US); Wei Yuan, Shenzhen (CN); Hai-Jun Wang, Shenzhen (CN); Ting-He Wu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,817

(22) Filed: Jun. 13, 2008

(65) Prior Publication Data

US 2008/0305689 A1 Dec. 11, 2008

Related U.S. Application Data

(63) Continuation-in-part of application No. 11/810,814, filed on Jun. 7, 2007, now Pat. No. 7,497,739.

(51) Int. Cl.
*H01R 13/648* (2006.01)

(52) U.S. Cl. ..... 439/607.11; 439/607.12

(58) Field of Classification Search ..... 439/79, 439/80, 638, 76.1, 608, 101, 189, 607.08, 439/607.16, 607.11, 607.12, 109
See application file for complete search history.

(56) References Cited

U.S. PATENT DOCUMENTS

| | | | | |
|---|---|---|---|---|
| 4,975,066 | A * | 12/1990 | Sucheski et al. | 439/63 |
| 6,071,150 | A | 6/2000 | Tang et al. | |
| 6,364,713 | B1 | 4/2002 | Kuo | |
| 6,572,410 | B1 * | 6/2003 | Volstorf et al. | 439/607.27 |
| 6,663,434 | B1 | 12/2003 | Wu | |
| 6,918,774 | B2 | 7/2005 | Wu | |

* cited by examiner

*Primary Examiner*—Javaid Nasri
(74) *Attorney, Agent, or Firm*—Wei Te Chung; Andrew C. Cheng; Ming Chien Chang

(57) ABSTRACT

A high speed electrical connector assembly (1) comprises a female connector (2) and a male connector (3) assembled together to be electrical connection to a printed circuit board (9). A plurality of differential pairs of signal contact (51) and a plurality pairs of ground contact (53) with the pairs of signal contacts (51) arranged therebetween are secured in the connector assembly (1). Each of the differential pairs of signal contact (51) has a first contact engaging portion (511) which is accessible from the female connector (2), and includes a second contact engaging portion (513), extending away from the first engaging portion (511) and accessible from the male connector (3). A shielding bus (10) is electrically interconnecting to at least one of the ground contact (53), and includes a shroud portion substantially enclosing the median portion of the pair of signal contacts (51).

6 Claims, 8 Drawing Sheets

HIGH SPEED ELECTRICAL CONNECTOR ASSEMBLY WITH SHIELDDING SYSTEM

CROSS-REFERENCE TO RELATED APPLICATIONS

This application is a continuation-in-part of U.S. patent application Ser. No. 11/810,814 (hereinafter referred to as the '814 application), filed on Jun. 7, 2007 now U.S. Pat. 7,497,739, the contents of each of which are hereby incorporated by reference.

BACKGROUND OF THE INVENTION

1. Field of the Invention

The present invention relates to an electrical connector, and more particularly to a high speed electrical connector for coupling an electrical device to a backplane and featured with a shielding system.

2. Description of the Related Art

U.S. Pat. No. 6,071,150 issued to Tang et al. on Jun. 6, 2000, discloses an extender (10) including a male section (12) and a female section (14) assembled together to be coupled between a female connector on a backplane in the computer and a male connector on a hard disk drive for establishing signal transmission between the hard disk drive and the backplane through the interconnections of such male and female sections. Specifically, the female section defines a female interface adapted for mating with the male connector from the hard disk drive, the male section defines an opposite male interface adapted to mate with the female connector from the backplane of the computer, and a plurality of contacts are configured to extend from the female interface towards the male interface for electrically connecting the female section with the male section. This configuration typically enables the female or male interface to supply one voltage for the male connector of the hard disk drive, or the female connector of the backplane.

U.S. Pat. No. 6,918,774 issued to Wu on Jul. 19, 2005 discloses an electrical connector (1) includes a dielectric housing (2) including front and rear housing portions (20, 22) each defining a number of juxtaposed channels (202) therein and an intermediate housing portion (24) interconnecting the front housing portion with the rear housing portion. A number of elongate circuit boards (3) are side by side retained in the housing along a second direction perpendicular to the first direction. The circuit boards include front and rear mating edges (30, 32) respectively received in the channels of the front and the rear housing portions for mating with complementary components.

U.S. Pat. No. 6,663,434 issued to Wu on Dec. 16, 2003 discloses an extender (10) includes a female portion (12) and a male portion (14) adapted to be back-to-back assembled. The female portion comprises a first housing (16) defining two slots (28) and a plurality of first contacts (18, 19). A plurality of first passageways (30) is defined in the first housing and communicates with the slots. The first contacts are retained into the first passageways. The male portion comprises a second housing (40) having a pair of tongues (46) and a plurality of second contacts (41). The tongues define a plurality of positioning slits (52, 53) for receiving the second contacts. Each of the first contacts is aligned and cooperated with a corresponding second contact to form a transmission path. Two pairs of latch devices (35, 60) are provided on opposite ends of the female portion and male portion for fastening each other.

In the past, the electrical device, such as a hard disk data storage, and a backplane on which the device is electrically interconnected, generally carry the same voltage, i.e. both are operated under the substantially identical working environment. However, when data transmission rate becomes faster and faster, their working environments have to change also so as to meet the requirements.

The present problem the users confront, is that the female or male interface substantially requires an electronic device of a first predetermined voltage to be equipped therewith, while the electronic component available for the users has a second predetermined voltage. In other words, the conventional configuration has no capability to provide a flexible connection to different types of electronic devices, which may require voltages of different amounts.

In the previously filed '814 application, applicant initiated a novel design such that a mating interface of an extender is supplied two different working voltages, and which indeed meets the current requirements.

In addition, when the requirement regarding to the data transmission rate becomes higher and higher, differential pair of signal contacts are used, and once the differential pair of contacts are used, grounding or shielding of the differential pair of contacts becomes a new challenge to resolve. When signal pins of different differential pairs become coupled with one another, the signal pins exhibit cross talk. Cross talk increases the interference, noise and jitter within the circuit board, connector and system. Increasing the distance between signal pins of separate differential pairs typically decreases the effects of interference, noise and jitter. Increasing the distance between differential pairs typically requires a larger connector. However, electrical and electronic applications today require a large number of differential pairs to be packaged in a small space. Many systems require as small a connector as possible to make efficient use of internal space. None of the above described prior arts consider the use of differential pair of contacts. In addition, a grounding arrangement between the first and second mating interfaces, and a circuit substrate on which the extender is mounted is not provided as well.

SUMMARY OF THE INVENTION

A high speed electrical connector assembly made according to an embodiment of the present invention comprises a female connector and a male connector assembled together to be electrically connected to a printed circuit board. The female connector includes a first mating face that interfaces with a mating face of a corresponding connector mounted on a hard disk drive. The male connector includes a second mating face opposite to the first mating face and adapted to mate with a connector mounted on a backplane. The connector assembly includes a mounting face that is orthogonal to the first and second mating faces and adapted to mate with the printed circuit board. The printed circuit board supplies two predetermined voltages for the female connector and/or the male connector, thereby achieving a flexible connection for the connector assembly to different types of hard disk and backplane.

According to one aspect of the present invention, the female connector includes a first insulative housing that has a first mating face and a first abutment face opposite to the female mating face. The female connector further comprises two contact modules that respectively having a first row of contacts insert molded to a first base and a second row of contacts insert molded to a second base. Each of the first row of contacts includes a first contact engaging portion which accessible from the first mating face of the female connector. Each of the second row of contacts includes a plurality of differential pairs of signal contact and a plurality pairs of ground contact with the pairs of signal contacts arranged therebetween. Each of the differential pairs of signal contact includes a median portion which are molded with a plastic portion, a first contact engaging portion extending from the median portion and which is accessible from the first mating face, and a second contact engaging portion extending away from the first engaging portion and which is accessible from the second mating face. Besides, a metal cover is secured between the plastic portion and a plastic plate for partially surrounding the medial portion of the differential pair of signal contacts. The ground contact comprises a first contact engaging portion which is accessible from the first mating face, and a tail portion extending from the first engaging portion that is orthogonal to the first contact engaging portion for electrical connection to the printed circuit board.

Yet, still according to another aspect of the present invention, the male connector includes a second insulative housing that has a second mating face and a second abutment face opposite to the second mating face. A plurality of passageways extend from the mating face to the abutment face for receiving the second engaging portion of the two rows of contacts from the female connector and a plurality of contacts that extend from the second mating face toward the mounting face. Each contact is a right angle configuration, with a second contact engaging portion which accessible from the second mating face, and a tailing portion extending orthogonal to the first contact engaging portion to be electrical connection to the printed circuit board.

Yet, still according to another aspect of the present invention, the first abutment face of the female connector and the second abutment face of the male connector include interengaging elements extending therefrom for fastening the female connector to the male connector. In addition, the connector assembly further includes a shielding bus which is arranged between the female and male connectors includes a frame portion, a plurality of base portion that joint with the metal cover and substantially enclosing the median portion of the pairs of differential signal contact terminals, and a plurality of spring arms extend from the frame portion for electrically interconnecting to the ground contacts.

Due to the printed circuit board of providing two predetermined voltage for the first connector and/or the second connector, the mating face or the mating surface is capable of being coupled to the electronic devices of requiring different predetermined voltages. Thus, the electrical connector assembly provides a flexible connection to any commodity devices of different predetermined voltages.

Other features and advantages of the present invention will become more apparent to those skilled in the art upon examination of the following drawings and detailed description of preferred embodiments.

DETAILED DESCRIPTION OF PREFERRED EMBODIMENTS

Figure 1:
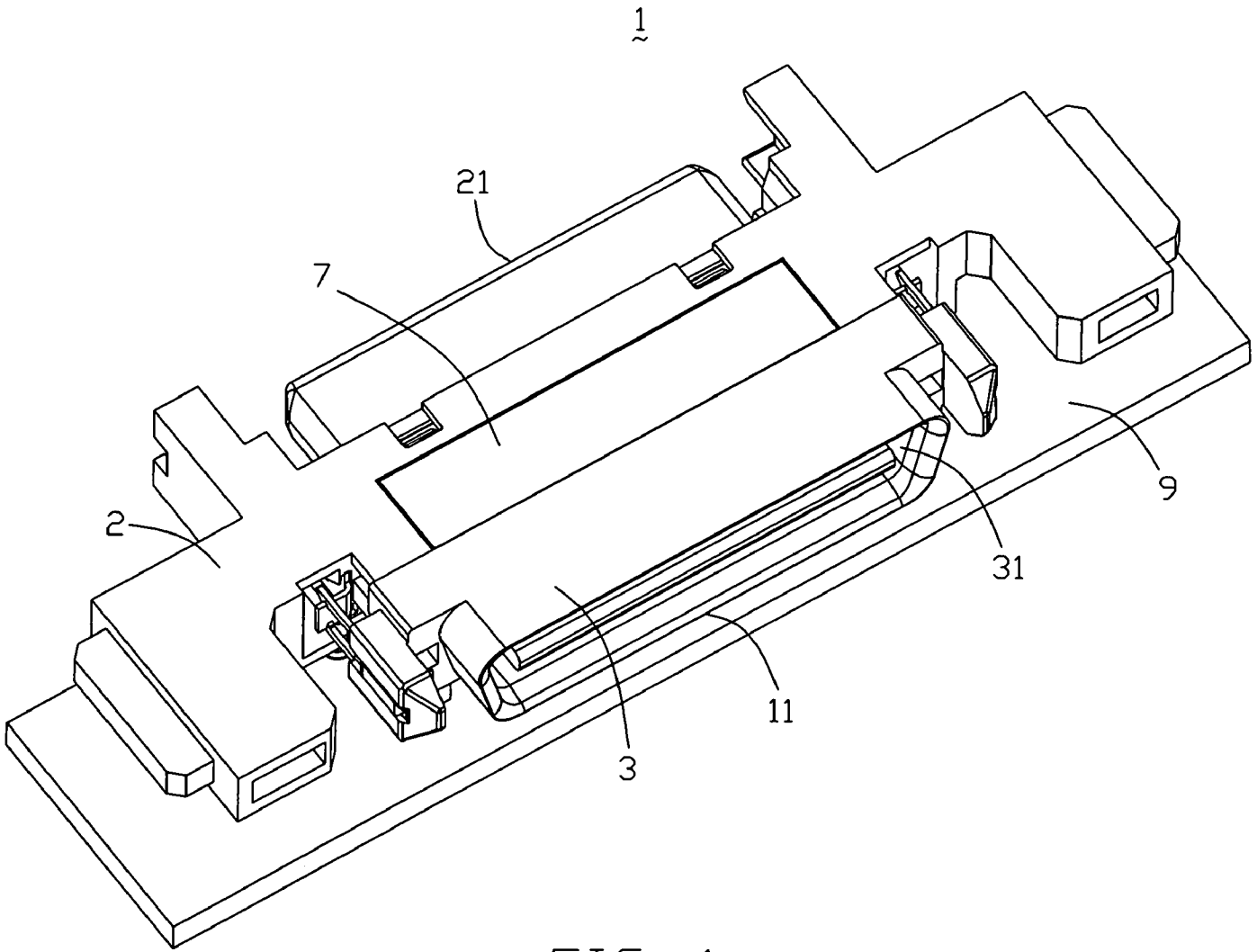
FIG. 1 is an assembled, perspective view of an electrical connector assembly according to an embodiment of the present invention.
Figure 2:
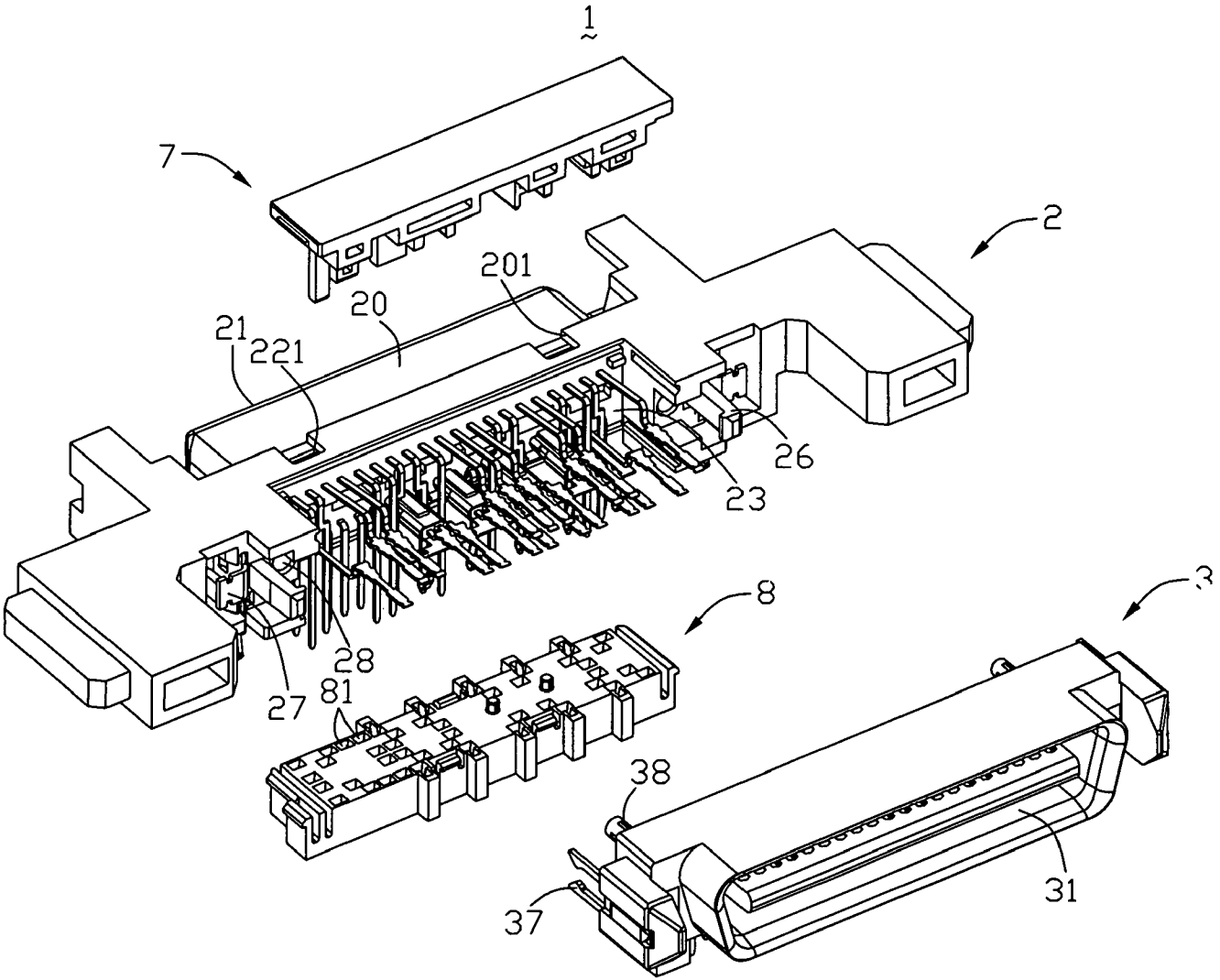
FIG. 2 is an exploded, perspective view of the electrical connector assembly according to an embodiment of the present invention.

As shown in FIGS. 1 and 2, a connector assembly 1 made in accordance with the present invention comprises a female connector 2 and a male connector 3 assembled together and is intended to be mounted onto a printed circuit board 9. The female connector 2 includes a first mating face 21 that interfaces with a mating face of a corresponding connector mounted on a hard disk drive (not shown). The male connector 3 includes a second mating face 31 opposite to the first mating face 21 and is adapted to mate with a connector mounted on a backplane (not shown). Of course, it should be appreciated that interfacing of hard disk and backplane is merely a typical embodiment of the present invention, and it is appreciated that the present invention can be also used with other interface, such as a cable assembly and a hard disk, and other interconnection currently available in the market. The connector assembly further includes a mounting face 11 that is orthogonal to the first and second mating faces 21, 31 to be adapted to face with the printed circuit board 9. Typically, according to an embodiment of the present invention, the printed circuit board 9 supplies two or more than two predetermined voltages to the female connector 2 and/or the male connector 3, respectively, thereby achieving a flexible connection for the connector assembly 1 to different types of hard disk and backplane.

Figure 3:
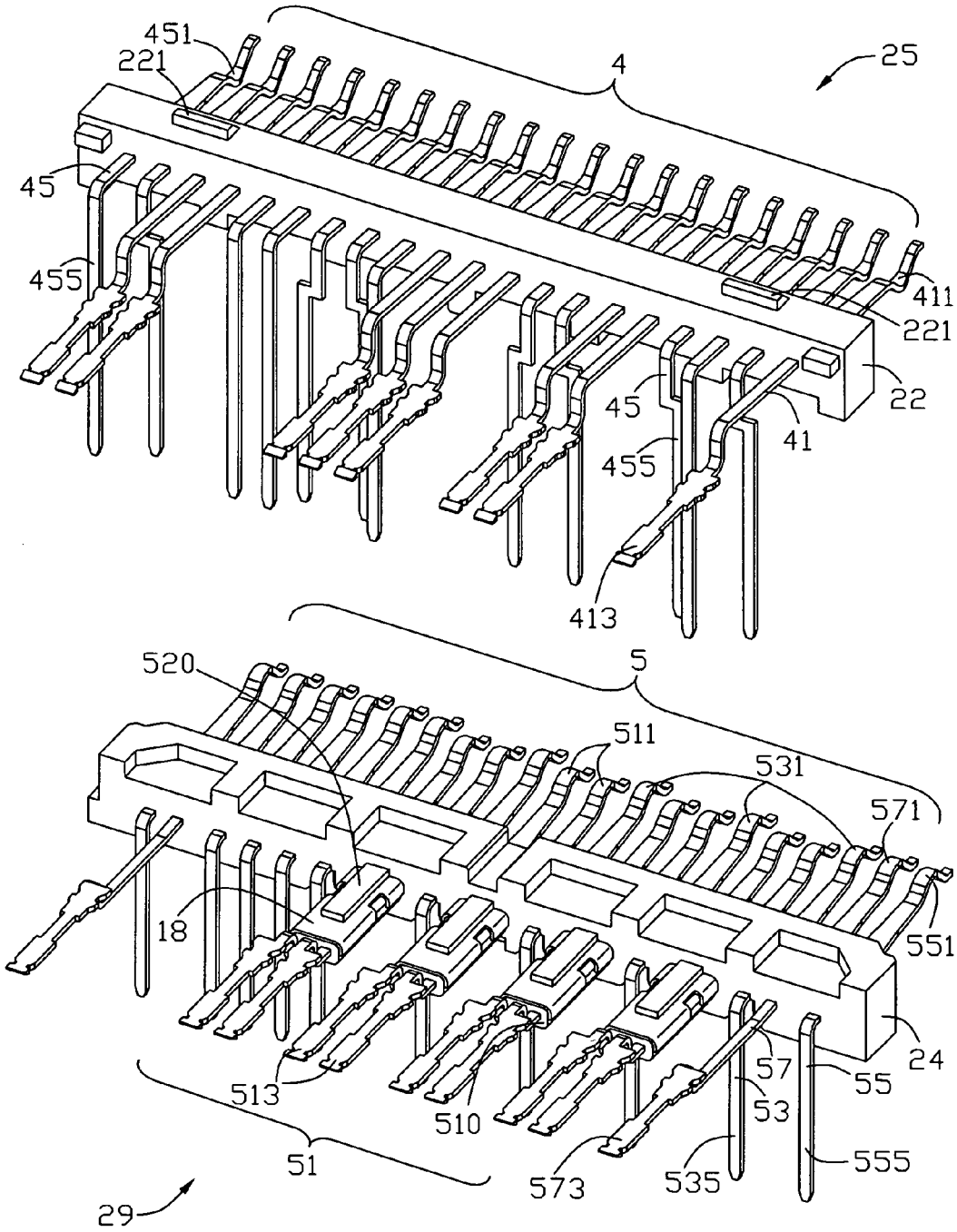
FIG. 3 is an exploded, perspective view of a contact module assembly of the electrical connector according to an embodiment of the present invention.
Figure 4:
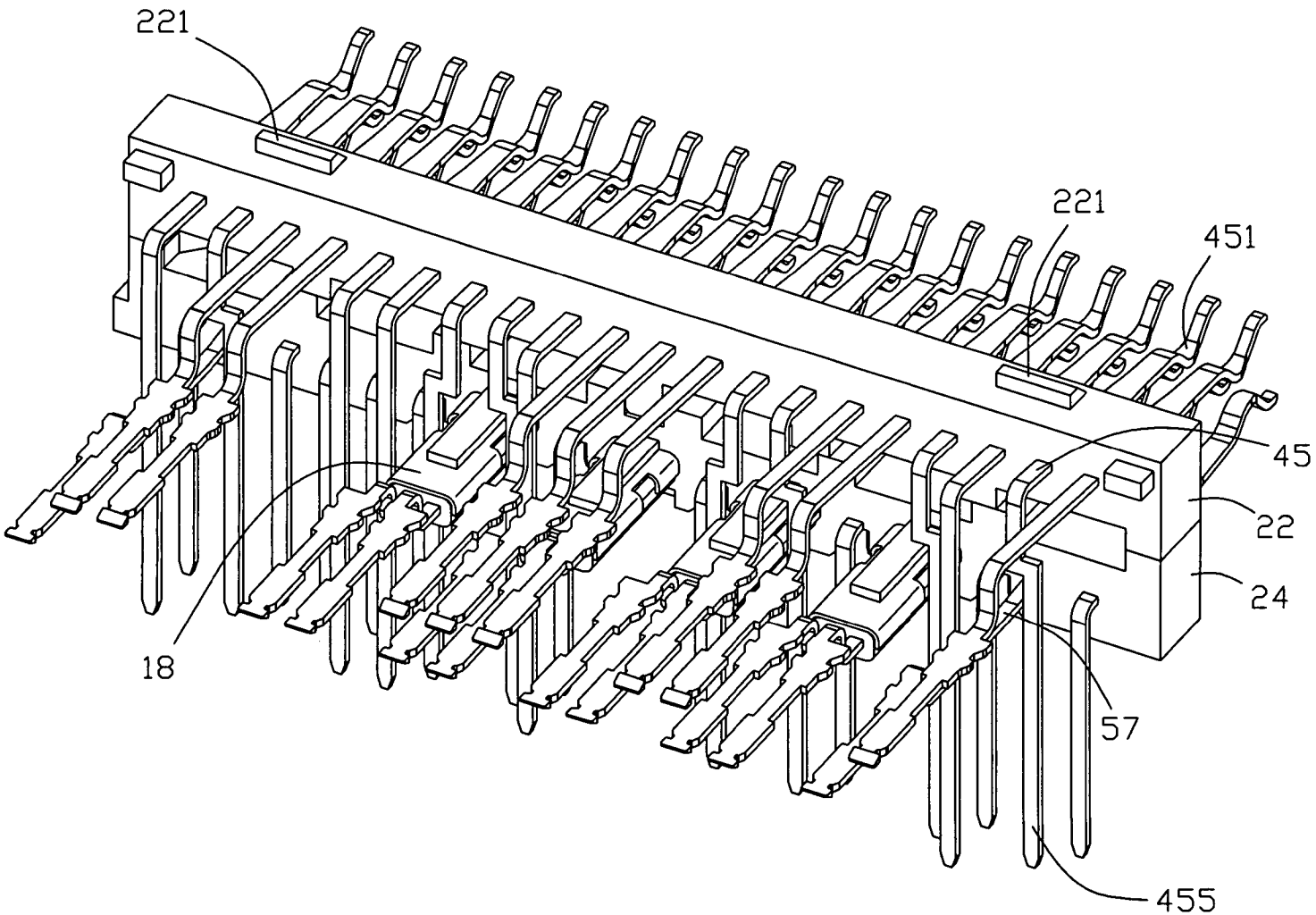
FIG. 4 is an assembled, perspective view of the contact module assembly of the connector assembly according to an embodiment of the present invention.

Referring now to FIGS. 2-4, the female connector 2 made in accordance with the present invention includes a first insulative housing 20 that has the first mating face 21 and a first abutment face 23 opposite to the first mating face 21. The female connector 2 further comprises two contact modules 25, 29 that respectively have a first row of contacts insert-molded to a first base 22 and a second row of contacts insert-molded to a second base 24. The first row of contacts 4 are configured by a first type of contact 41 which extends from the female connector 2 to the male connector 3, and a second type of contact 45 which is arranged within the female connector 2 only. Each of the first type of contacts 41 includes a first contact engaging portion 411 which is accessible from the first mating face 21 of the female connector 2, and includes a second contact engaging portion 413 extending away from the first engaging portion 41 and is accessible from the second mating face 31 of the male connector 3 when assembled therein. Each of the second type of contacts 45 includes a first contact engaging portion 451 which is accessible from the first mating face 21 of the female connector 2, and a tail portion 455 that is orthogonal to the first contact engaging portion 451 and extends to the mounting face 11 for electrical connection to the printed circuit board 9.

The second row of contacts 5 include a plurality of differential pairs of signal contact 51, a plurality pairs of ground contact 53 with the pairs of signal contacts 51 arranged therebetween, and a plurality of signal/power contacts 55, 57. Each of the differential pairs of signal contact 51 includes a median portion which are molded with a plastic portion 510, a first contact engaging portion 511 extending from the median portion and which is accessible from the first mating face 21, and a second contact engaging portion 513 extending away from the first engaging portion 511 and which is accessible from the second mating face 31. It can be noted that a metal cover 18 is secured between the plastic portion 510 and a plastic plate 520 for partially surrounding the medial portion of the differential pair of signal contacts 51.

The ground contact 53 includes a first contact engaging portion 531 which is accessible from the first mating face 21 of the female connector 2, and a tail portion 535 that is orthogonal to the first contact engaging portion 531 and extends to the mounting face 11 for electrical connection to the printed circuit board 9.

The signal/power contacts is configured by a first type of contact 57 which extends from the female connector 2 to the male connector 3, and a second type of contact 55 which is arranged within the female connector 2 only. The first type of contact 57 includes a first contact engaging portion 571 which is accessible from the first mating face 21 of the female connector 2, and a second contact engaging portion 573 extending away from the first engaging portion 571 and is accessible from the second mating face 31 of the male connector 3 when assembled therein. The second type of contacts 55 includes a first contact engaging portion 551 which is accessible from the first mating face 21 of the female connector 2, and a tail portion 555 that is orthogonal to the first contact engaging portion 551 and extends to the mounting face 11 for electrical connection to the printed circuit board 9.

As shown in FIG. 4, the contact modules 25, 29 are assembled together to be a module assembly. It can be noted that part of the tail 455 of the second type of contact 45 is shifting away from the middle line of the first contact engaging portion 451, so as to sidestep the median portion of the signal/power contact 57 to connect to the print circuit board 9. Pairs of locking blocks 221 are formed on the base 22, 24 so as to be engaged to correspondent pairs of cavities 201 of the first insulative housing 20 for fastening the module assembly to the first insulative housing 20.

Figure 5:
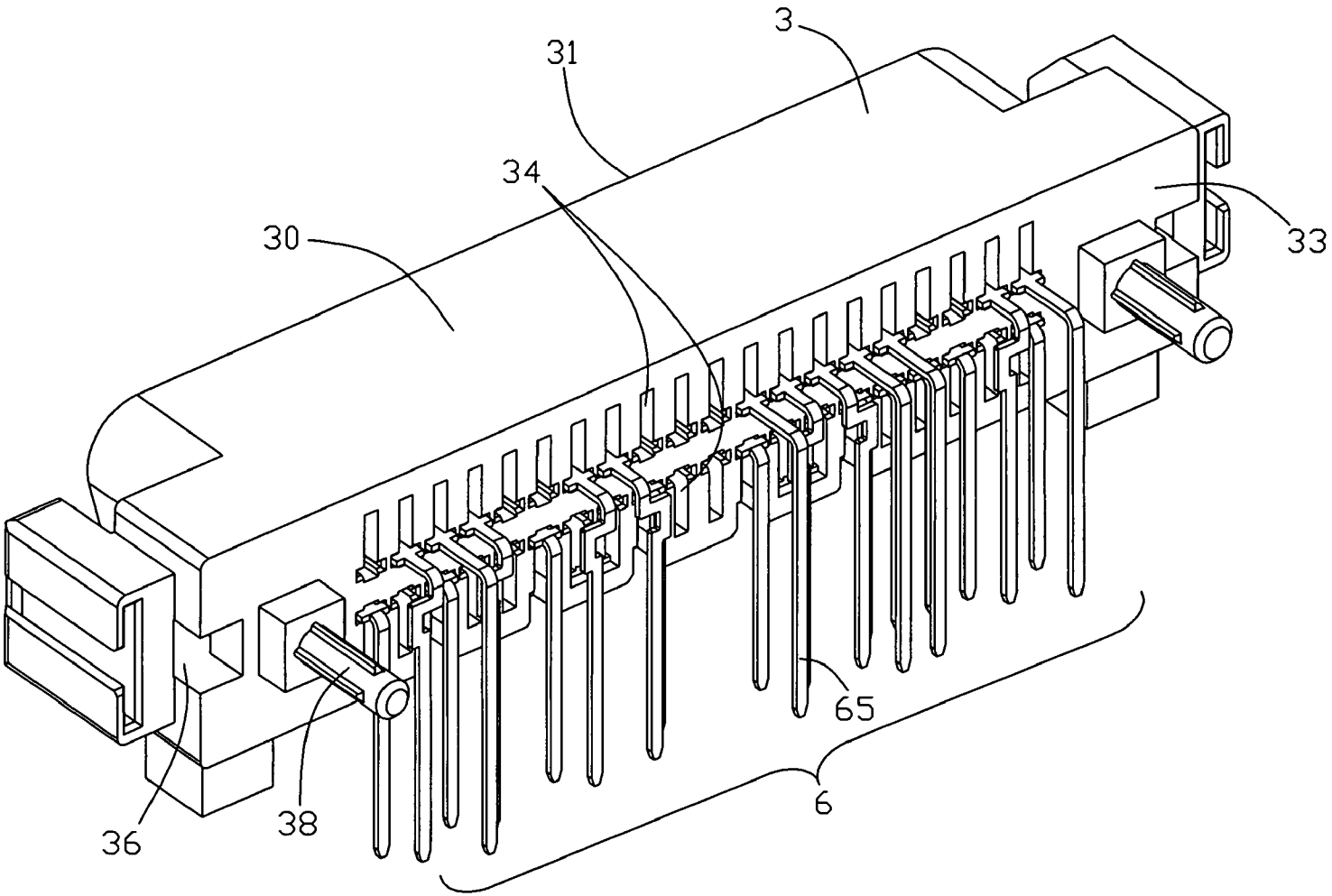
FIG. 5 is an isometric view of a male connector of the electrical connector assembly according to an embodiment of the present invention.
Figure 6:
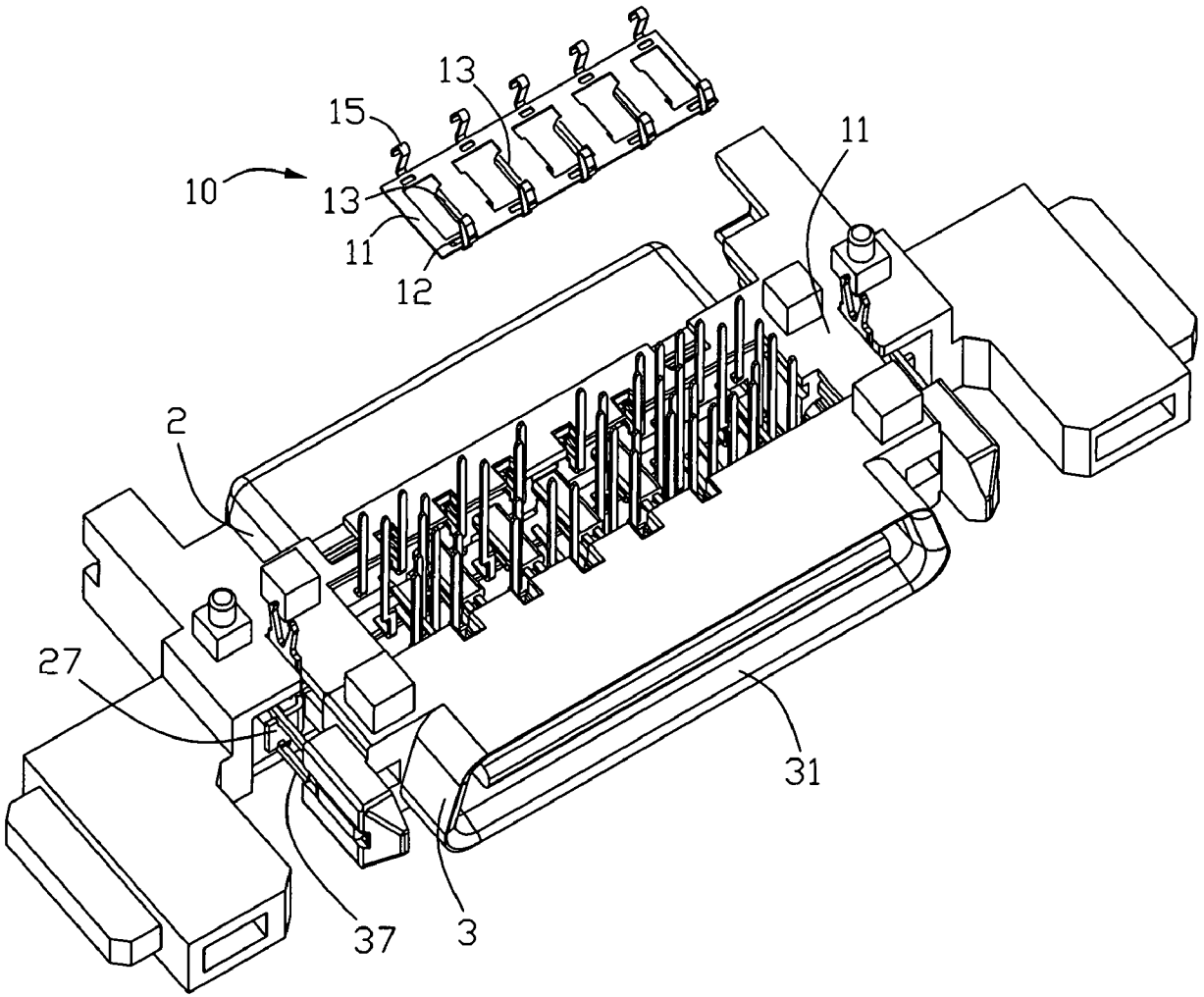
FIG. 6 is a perspective view of a shielding bus before setting on the electrical connector according to an embodiment of the present invention.

With respect to FIG. 5-6, the male connector 3 includes a second insulative housing 30 that has a second mating face 31 and a second abutment face 33 opposite to the second mating face 31. A plurality of passageways 34 extend from the mating face 31 to the abutment face 33 to receiving the second engaging portion 413, 513, 573 of the two rows of contacts 4, 5 from the female connector and a plurality of contacts 6 that extend from the second mating face 31 toward the mounting face 11. Each of the contacts 6 has a right angle configuration, with a second contact engaging portion 63 which is accessible from the second mating face 31, and a tailing portion 65 extending orthogonal to the first contact engaging portion 63 to be electrical connection to the printed circuit board 9.

Referring to FIGS. 2 and 5-6, the first abutment face 23 of the female connector 2 and the second abutment face 33 of the male connector 3 include interengaging elements extending therefrom for fastening the female connector 2 to the male connector 3. More specifically, the second abutment face 33 of the male connector 3 has a pair of indents 36 extending thereinto for latchably receiving the inwardly oriented latches 26 disposed adjacent to two ends of the first abutment face 23 of the female connector 2. A pair of alignment posts 38 extending outwardly therefrom for being engageably received within alignment slots 28 of the first abutment face 23. A pair of metal latches 37 secured in the side wall of the male connector 3 for locking a pair of metal plates 27 securely to adjacent two ends of the female connector 2. Therefore, the male connector 3 and the female connector 2 could be assembled together.

Figure 7:
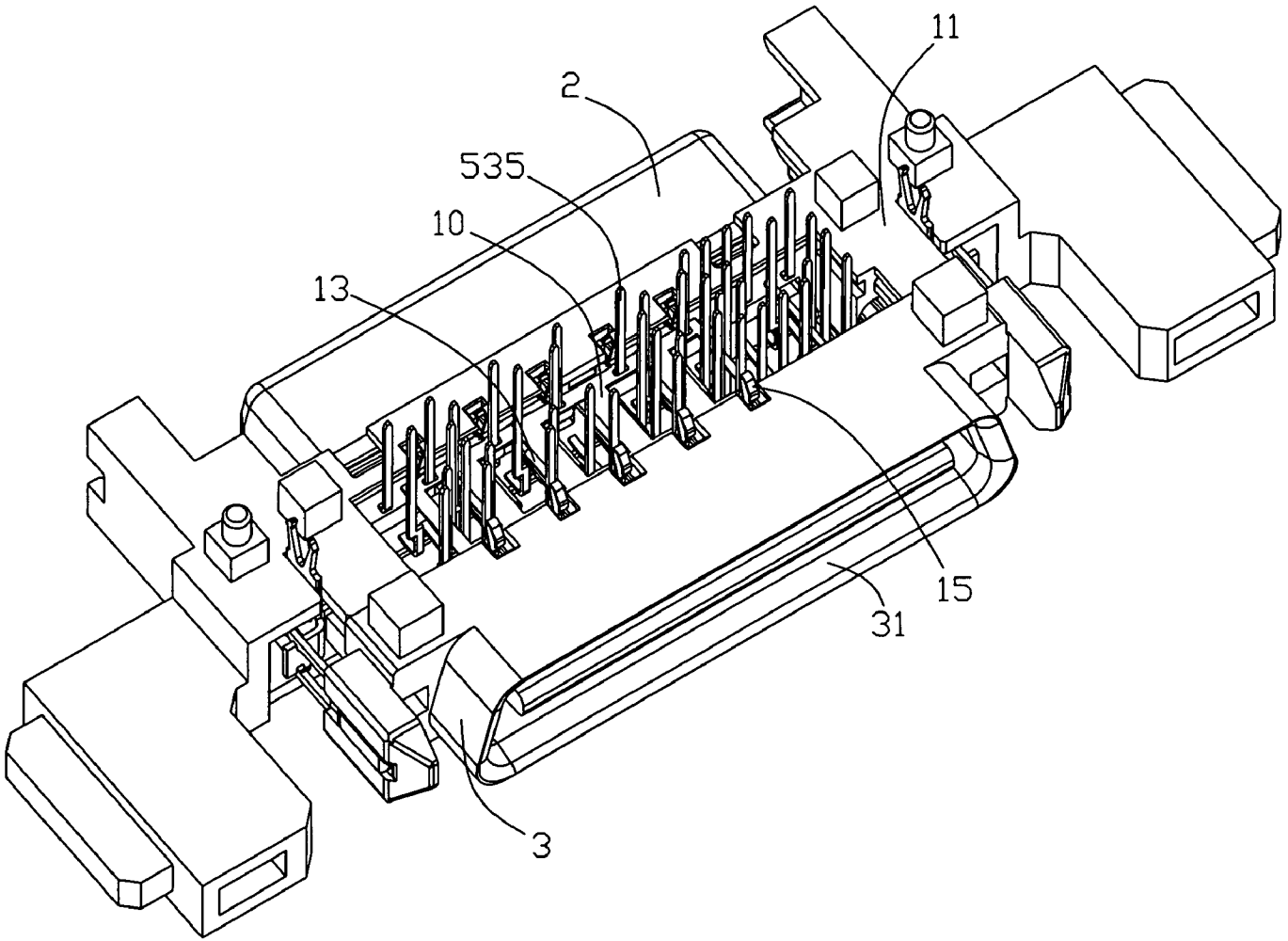
FIG. 7 is a bottom view showing a mounting face of the electrical connector assembly according to an embodiment of the present invention.
Figure 8:
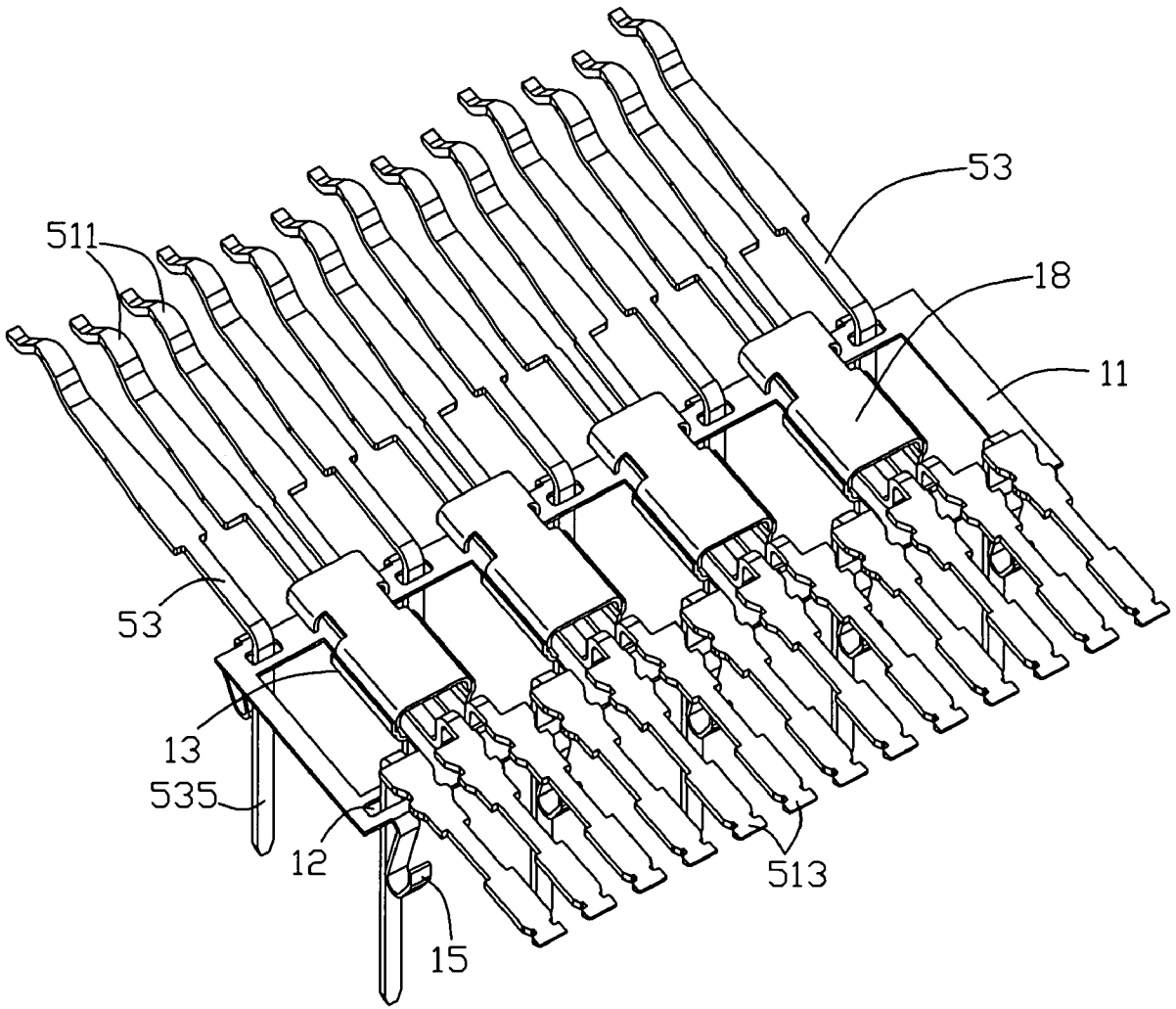
FIG. 8 is a perspective view of the shielding bus and a plurality of ground contacts of the electrical connector assembly according to an embodiment of the present invention.

Referring to FIGS. 6-8, a shielding bus 10 is arranged between the female and male connectors 2, 3, and includes a frame portion 11, a plurality of base portion 13 that joint with the metal cover 18, which functions as a shroud portion, and substantially enclosing the median portion of the pairs of differential signal contact terminals 51, and a plurality of spring arms 15 extend from the frame portion 11 for electrically interconnecting to the ground contacts 53. Besides, the frame portion 11 includes a plurality of through holes 12 which are adjacent to the spring arms for receiving the tail portion 535 of the ground contacts 53.

In addition, the connector assembly further includes a middle cover 7 disposed on a top region between the female connector 2 and the male connector 3, and a middle spacer 8 on a bottom region between the female connector 2 and the male connector 3. The middle spacer 8 defines a plurality of through holes 81 for receiving the tailing portions 455, 535, 555, 65 of the contacts 4, 5, 6 to be penetrated therethrough so as to be electrical connection to the printed circuit board 9.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A high speed connector assembly with a shielding system, comprising:

a plurality of pairs of differential signal contact terminals and each of the signal contact terminals having a median portion, a first engaging portion extending from the median portion, and a second engaging portion extending from the median portion opposite to the first engaging portion;

a plurality of pairs of ground contact terminals with the pairs of signal contact terminals arranged therebetween, wherein at least one of said ground contact terminals has a tail portion angled away from the median portion of one of the signal contacts; and a shielding ground bus having a first portion electrically interconnecting to at least one of the pairs of ground contact terminals, and a second shroud portion different from the first portion and substantially enclosing the median portions of the pair of differential signal contact terminals;

the shielding bus further comprising at least one spring arm to interconnect to one of the ground contact terminals.

2. The connector assembly as recited in claim 1, the shielding bus further comprising at least one through hole adjacent to the spring arm for receiving said one of ground contact terminals.

3. A high speed connector assembly, comprising:

a first connector having a first mating face, and a second connector opposite to the first connector and with a second mating face;

a pair of signal contacts arranged between the first and second connector, each with a median portion, a first engaging portion extending from the median portion and accessible in the first mating face, and a second engaging portion extending from the median portion opposite to the first engaging portion and accessible in the second mating face;

a pair of ground contacts with the pair of signal contacts arranged therebetween; and a shielding ground bus having a first shroud portion electrically interconnecting to at least one of the ground contact, and a second shroud portion different from the first portion and substantially enclosing the median portions of the pair of signal contacts; wherein the second shroud portion is configured with an upper base and a lower base jointly and substantially fully enclosing the median portions of the corresponding pair of signal contacts.

4. The high speed connector assembly as recited in claim 3, wherein said first connector is linearly opposite to the second connector rather than with any other angles.

5. The high speed connector assembly as recited in claim 3, wherein there are some other contacts disposed in the first connector without extending into the second connector but extending in a direction perpendicular to an axial direction of said shroud portion for mounting to a printed circuit board.

6. The high speed connector assembly as recited in claim 3, wherein at least one of said ground contact has a tail portion angled away from said base portion of one of the signal contacts.

* * * * *